United States Patent [19]

Goss et al.

[11] Patent Number: 4,703,322

[45] Date of Patent: Oct. 27, 1987

[54] VARIABLE LOADABLE CHARACTER GENERATOR

[75] Inventors: Gary J. Goss, Acton; Thomas O. Holtey, Newton, both of Mass.; James C. Siwik, Nashua, N.H.

[73] Assignee: Honeywell Information Systems Inc., Waltham, Mass.

[21] Appl. No.: 946,663

[22] Filed: Jan. 5, 1987

Related U.S. Application Data

[63] Continuation of Ser. No. 873,835, Jun. 9, 1986, abandoned, which is a continuation of Ser. No. 504,092, Jun. 13, 1983, abandoned.

[51] Int. Cl.[4] ..... G09G 1/16

[52] U.S. Cl. ..... 340/750; 340/802; 340/801; 340/703; 340/723

[58] Field of Search ..... 340/744, 745, 748, 750, 340/703, 723, 802, 800, 801

[56] References Cited

U.S. PATENT DOCUMENTS

| | | | |
|---|---|---|---|
| 2,920,312 | 1/1960 | Gordon | 340/749 |
| 3,422,420 | 1/1969 | Clark | 340/749 |
| 3,631,455 | 12/1971 | Gregg, Jr. | 340/801 |
| 3,729,730 | 4/1973 | Sevilla et al. | 340/790 |
| 4,258,361 | 3/1981 | Hydes et al. | 340/790 |
| 4,375,079 | 2/1983 | Ricketts et al. | 340/790 |
| 4,439,761 | 3/1984 | Fleming et al. | 340/790 |

*Primary Examiner*—Marshall M. Curtis

*Attorney, Agent, or Firm*—Nicholas Prasinos; John S. Solakian

[57] ABSTRACT

A Loadable Character Generator whose operation can be changed to suit various needs, such as foreign language requirements, without hardware change and with minimum hardware. The character generator translates the character code of a character to be displayed to the dot pattern for that particular character, utilizing a minimum of hardware. The loadable character generator of the invention replaces the ROM/PROM by a RAM utilizing 2K and 8 RAM memories, a 4K by 8 memory, 4 MUX chips, and a Motorola 6845 CRT Controller with various registers and is loaded through the attribute buffer.

2 Claims, 10 Drawing Figures

SHEET 1 of 2

SHEET 2 of 2

SHEET 1of4

SHEET 2 of 4

SHEET 3of4

SHEET 4 of 4

| | 0 | | 1 | | 2 | | | 65 | | | 127 | |
|---|---|---|---|---|---|---|---|---|---|---|---|---|
| 0 - 127 | 0 | P0.0 | 1 | P1.0 | 2 | P2.0 | | 65 | P65.0 | | 127 | P127.0 |
| 128 - 255 | 0 | P0.1 | 1 | P1.1 | 2 | P2.1 | | 65 | P65.1 | | 127 | P127.1 |
| 256 - 383 | 0 | P0.2 | 1 | P1.2 | 2 | P2.2 | | 65 | P65.2 | | 127 | P127.2 |
| 384 - 511 | 0 | P0.3 | 1 | P1.3 | 2 | P2.3 | | 65 | P65.3 | | 127 | P127.3 |
| 512 - 639 | 0 | P0.4 | | | | | | | | | | |
| 640 - 767 | 0 | P0.5 | | | | | | | | | | |
| 768 - 895 | 0 | P0.6 | | ⋮ | | ⋮ | | | ⋮ | | | ⋮ |
| 896 - 1023 | 0 | P0.7 | | | | | | | | | | |
| 1024 - 1151 | 0 | P0.8 | | | | | | | | | | |
| 1152 - 1279 | 0 | P0.9 | | | | | | | | | | |
| 1280 - 1407 | 0 | P0.10 | | | | | | | | | | |
| 1408 - 1535 | 0 | P0.11 | | | | | | | | | | |
| 1536 - 1663 | 0 | P0.12 | | | | | | | | | | |
| 1664 - 1791 | 0 | P0.13 | | | | | | | | | | |
| 1792 - 1919 | 0 | P0.14 | | | | | | | | | | |
| 1920 - 2047 | 0 | P0.15 | 1 | P1.15 | 2 | P2.15 | | 65 | P65.15 | | 127 | P127.15 |

FIG. 8

| PASS | STARTING ADDRESS | NO. OF SCAN LINES |
|---|---|---|
| 1 | 1920 | 16 |
| 2 | 1792 | 15 |
| 3 | 1664 | 14 |
| 4 | 1536 | 13 |
| 5 | 1408 | 12 |
| 6 | 1280 | 11 |
| 7 | 1152 | 10 |
| 8 | 1024 | 9 |
| 9 | 896 | 8 |
| 10 | 768 | 7 |
| 11 | 640 | 6 |
| 12 | 512 | 5 |
| 13 | 384 | 4 |
| 14 | 256 | 3 |
| 15 | 128 | 2 |
| 16 | 0 | 1 |

FIG. 9

VARIABLE LOADABLE CHARACTER GENERATOR

This application is a continuation of application Ser. No. 873,835, filed 6/9/86, now abandoned, which is a continuation of Ser. No. 504,092, filed June 13, 1983, now abandoned.

BACKGROUND OF THE INVENTION

1. Field of the Invention

This invention relates in general to computer systems and more particularly to an apparatus and method for generating the various types of character sets including multiple national language character sets.

2. Description of the Prior Art

The character generator is the means for translating from the character code associated with a particular character to be displayed on a cathode ray tube to the dot pattern for that particular character. In order to achieve suitable speeds, character generators are usually implemented in hardware using a table look-up scheme with a table stored in a dedicated memory, usually a ROM/PROM with the character code serving as a portion of the address to the memory. There are various methods for character generation.

An overview of the technology of receiving digital coded data and displaying it in decoded form on a cathode ray tube is presented in the decision of the court in RCA Corp V. Applied Digital Data Systems Inc., 217 U.S.P.Q. 421 (D.C. Del 1983). One type of system stores character codes for a display, and those codes are applied through a character generator to generate the video bits to be applied to the CRT with each raster scan.

The advantage of the raster scan technique of generating characters by digital techniques comes into play only if one can operate at speeds at least equal to commercial or entertainment TV rates. This requirement is met in the prior art by utilizing ROM/PROMs to achieve the speed. This technique has the limitation of requiring a dedicated memory for character generation, thus only one character set can be generated and additional character sets including different formats such as elite and pica and also foreign characters require additional hardware in the form of hardware in ROMs/-PROMs. This necessitates that the manufacturer store a variety of these pieces of hardware in order to provide full service to customers throughout the world.

What is needed, therefore, is a character generator that is loadable rather than fixed (ROM/PROM) so that multiple character sets can be provided with a single hardware configuration.

OBJECTS OF THE INVENTION

It is in object of the invention therefore to provide an improved character generator.

It is another object of the invention to provide an improved character generator for use in a computer terminal utilizing a cathode ray tube (CRT) as display.

It is still another object of the invention to provide an improved character generator that is loadable rather than fixed (ROM/PROM) so that multiple character sets can be provided with a single hardware configuration.

It is still a further object of the invention to provide an improved character generator which utilizes a minimum of hardware to make the character generator loadable.

These and other objects of the invention will become obvious upon a reading of the specification together with the drawings.

SUMMARY OF THE INVENTION

The soft loadable character generator of the invention replaces the ROM/PROM by a RAM utilizing 2K by 8 RAM memories, a 4K by 8 memory, 4 MUX chips, and a Motorola 6845 CRT Controller with various registers.

Eighty characters horizontally and 12 scan lines vertically are utilized per character row. A character code is read out of the display memory for each character position of each scan line. Each time a new character is read out of display memory, the character code is used as a portion of the address which is used to address the RAM which serves as the character generator. The remainder of the address for the character generator is taken from the scan line number. The address is comprised of 12 bits with the 8 high order bits comprising the character code and the 4 low order bits comprising the scan line number. As each scan line is scanned across the 80 character positions, an appropriate portion of the character will appear at each character-time until after a total of 12 scan lines are completed, the 80 characters are displayed on the screen.

BRIEF DESCRIPTION OF THE DRAWINGS

The manner in which the apparatus of the present invention is constructed and its mode of operation can best be understood in the light of the following detailed description, together with the accompanying drawings, in which:

FIG. 8 shows a typical organization of data in the Screen Buffer RAMs.

FIG. 9 shows typical values used for the Starting Address and Number of Scan Line parameters for sixteen passes of one row.

DETAILED DESCRIPTION OF THE PREFERRED EMBODIMENT

In order to understand the instant invention it is necessary to have an understanding of the formation of a picture on the CRT of a television set. The picture is formed by an electron beam which illuminates various points on the phosphor coating of the screen as it scans the area in which the image is to be displayed. Normally, the beam scans across one horizontal line at a time, starting at the top of the screen and moving sequentially down the screen to the bottom. This pattern of scan in which the beam proceeds across the entire width of the CRT screen before scanning a second horizontal line is referred to as the television raster scan pattern. By using a digital video control signal to appropriately control the intensity of the beam as it traverses the screen, the beam can be used to form a recognizable message or image. Because of its speed, the beam's movement is not detectable by the eye.

Figure 1A:
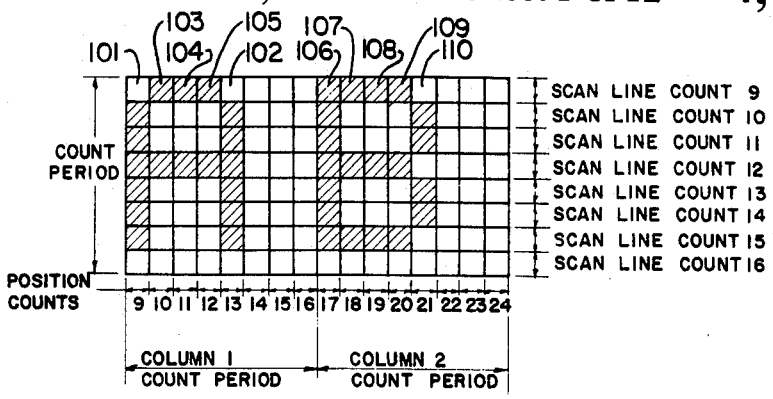
FIG. 1A PRIOR ART
FIGS. 1A and 1B are prior art presentations of the methods of generating characters on a Cathode Ray Tube (CRT) utilizing video signals.
Figure 2:
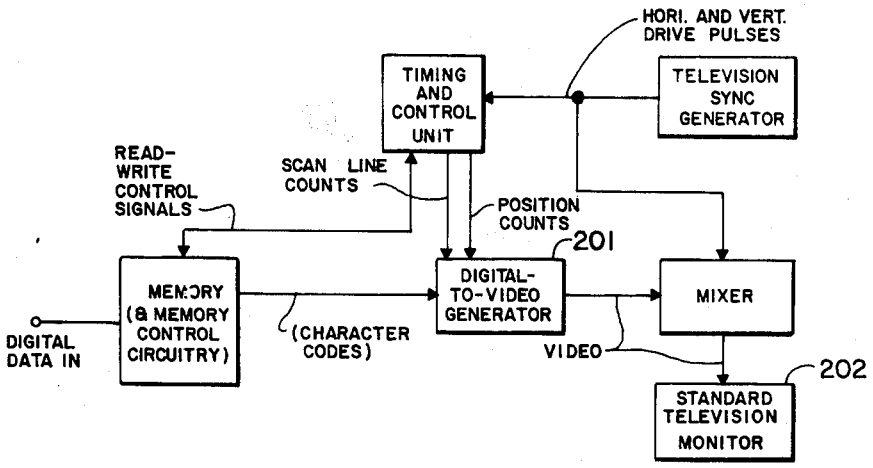
FIG. 2 PRIOR ART
FIG. 2 is a prior art block diagram of the method of generating characters on a CRT utilizing digital signals.

Each character of the set can be represented by an array of dots in a rectangular matrix having fixed dimensions (e.g., 5 dots wide and 7 scan lines high, or as in the instant invention, 7 dots wide and 9 dots high). The character is displayed on the CRT screen within a character space which includes the dot matrix of the character, and additional blank spaces to separate the characters on the screen (e.g. 9 dots wide by 12 scan lines high). Two such adjacent character spaces are shown in prior art FIG. 1A. As the beam moves across the screen in a scan line, the computer codes for each of the characters to be written in a row across the screen are sequentially provided from a memory to a decoder or "character generator". As shown in prior art FIG. 2, timing and control circuitry produce count signals which represent the scan line of the raster and the dot position along the scan line. Character-code information, the scan-line count signal, and the dot position count signal are applied to the character generator, label Digital to Video Generator 201, which converts the signals into a 2-level, serial digital output. The output signal is applied to the television monitor circuitry 202 as a video signal. One digital level of the signal corresponds to a dot and turns on the electron beam to write a dot on the television screen. The other digital level corresponds to the absence of a dot, and leaves the electron beam turned off so that no dot is written. Dots thus produced as the electron beam moves along a scan line correspond to the dots in the appropriate horizontal slice of each of the characters to be displayed in the character row. Thus in FIG. 1A, dots 103 through 105 (for the character "A") and dots 106 through 109 (for the character "B") will be illuminated sequentially as the electron beam moves along the top scan line. The timing and control circuitry of FIG. 2 also provides horizontal and vertical drive pulses to the monitor 202 to synchronize the scanning motion of the beam with the video signal generated as described supra.

After completing one scan line, the electron beam flies back to the starting side of the screen, (but down one position due to the vertical sweep) to start the next scan line. The sequential application of character codes, scan line count and dot position count is then repeated, this time generating the video signals for the next dot slice of each of the characters in the row.

After the appropriate number of scan lines (e.g., 8 to 12) have been "written" onto the screen, a full row of characters is complete. The entire row has been written onto the screen, one scan line at a time, from top to bottom.

In a like manner, the additional rows of characters making up the message to be displayed on the screen are written. After the entire screen has been scanned, the procedure is repeated at a rate of 60 times per second so as to "refresh" the screen and create a display which the human eye perceives as the persistent, non-flickering image.

Figure 1B:
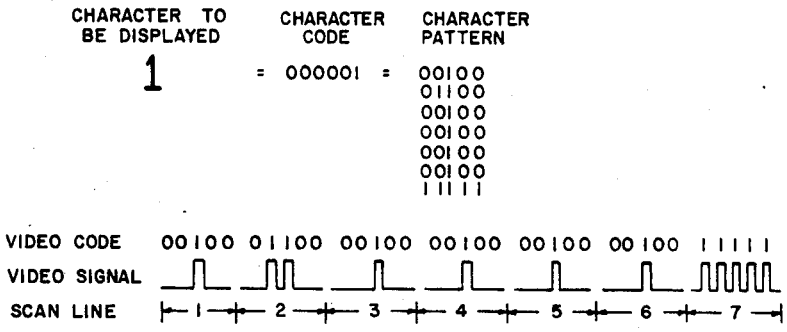
FIG. 1B PRIOR ART

Referring to FIG. 1B, there is an example of the translation of the code for the character "1" which is to be displayed on the screen. It should be noted that if the binary codes that are used for identifying the various characters were supplied directly to the CRT, the pattern on the screen would not generally be recognizable. Thus, the 6-bit code 000111 might represent a number "7", but would appear as 3 dark spots followed by 3 bright spots, or vice versa. Consequently it is necessary to translate the 6-bit binary code into a video signal which will represent a normal appearing character. To see how this is done refer to FIG. 1B which shows the code to pattern translation for the number "1". It should be noted that the video code for the first scan line is 00100 and the video signal which represents this code is a pulse in the position where the dot is to appear. Similarly, for scan line two the video code is 01100 whereby a video signal representing this video code is two pulses causing two dots to appear on scan line two. (When the final scan line is completed, the number "1" appears on the screen.

Figure 3:
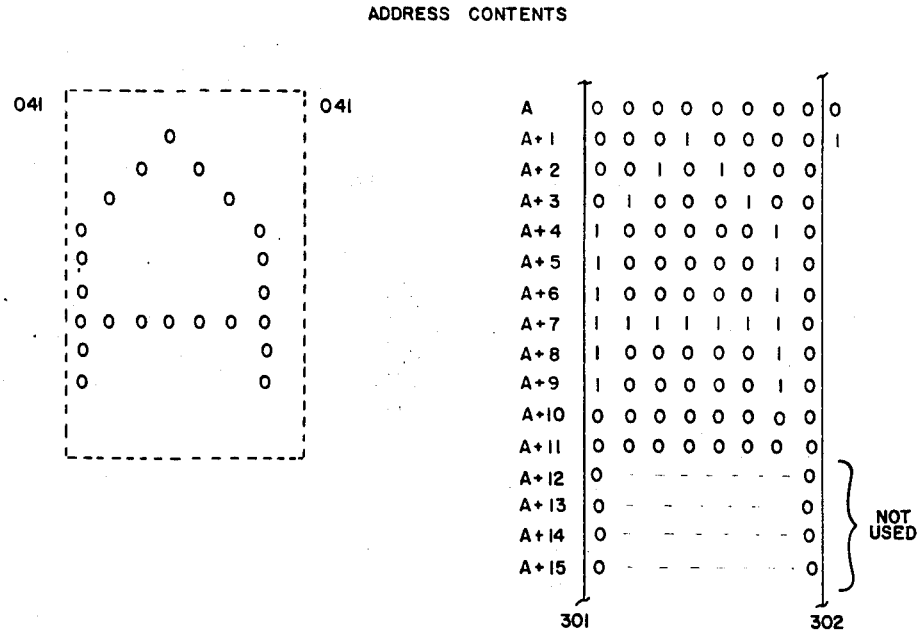
FIG. 3 is a schematic drawing of the addressing scheme of the invention for generating characters on a CRT utilizing video signals.

Referring now to FIG. 3, there is shown one character on one row in one column. There are 80 such character columns across the screen, and there are 25 character rows; thus 2000 characters can be generated on the page or screen. FIG. 3 shows how the letter "A" would be formed within the boundaries 301 to 302 when the total of 12 raster lines comprising one character row have been completed. (It should be noted that 9 raster lines are utilized in character generation; whereas 3 are added as a space between character lines.)

Figure 4:
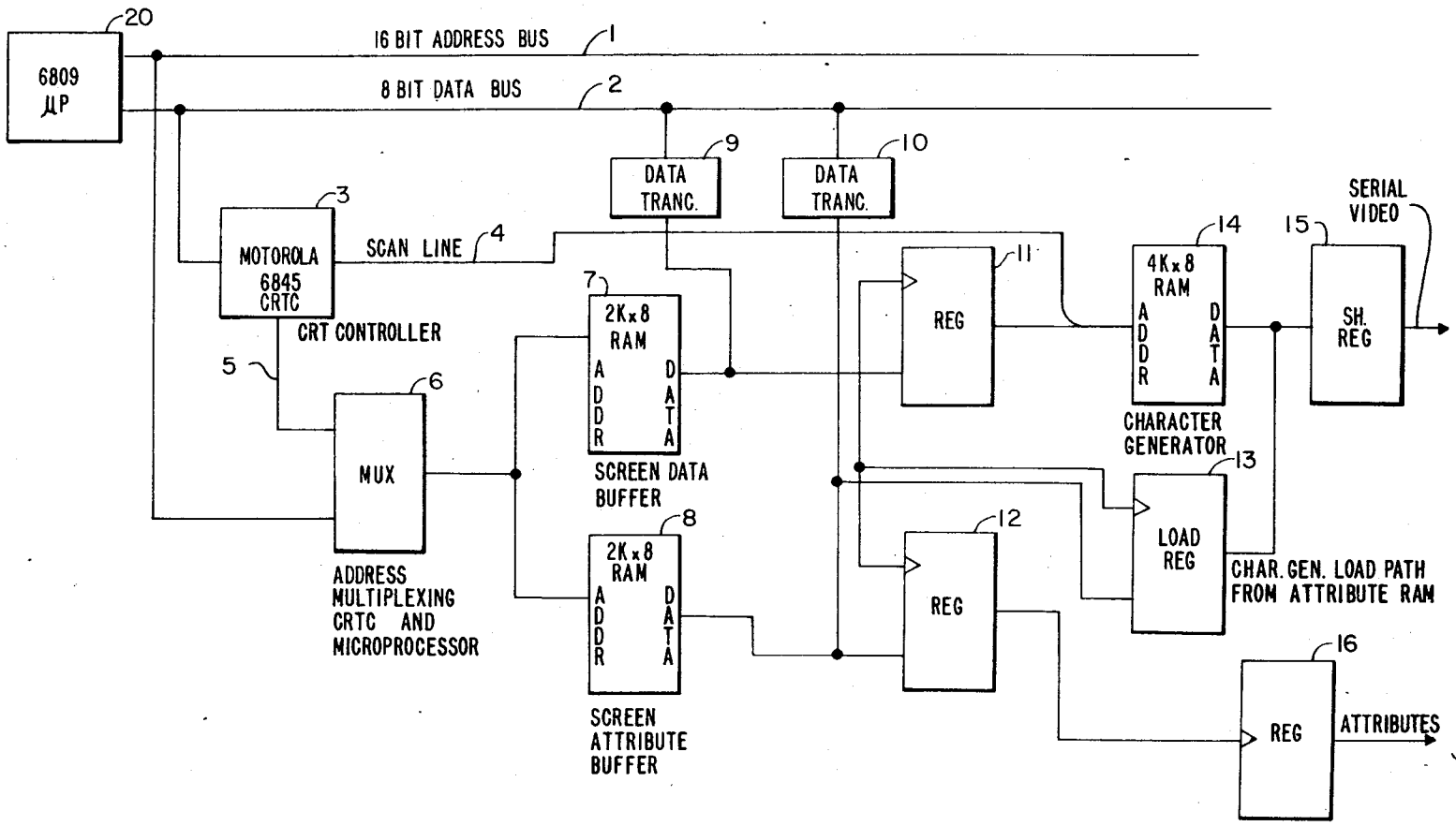
FIG. 4 is a high level logic block diagram of the invention.

In order to obtain this character (which may be part of a message), it first must be stored in a memory or buffer 7 shown on FIG. 4. In order to write this character on the screen, it must be generated by the character generator 14. The charactor generator stores different standard characters at different addresses which can be used to generate the characters of any message on the screen which is stored in buffer 7 as previously described. The pattern stored in the character generator 14 is addressed by utilizing the code of the character in the message as part of the address. In this case the hexadecimal code for "A" is 041, while the decimal code is 65. The address of the letter "A", therefore, would be $65\times16$ for the first raster line, and for the second it would be $(65\times16)+1$, etc. As each raster line progresses across the screen, the patterns for different characters of the message are similarly addressed by their codes and a portion of each is generated until one full character line is generated by 9 successive raster lines.

Referring now to FIG. 4, there is shown a high level logic block diagram of the invention. Two busses, a 16-bit address bus 1 and and 8-bit data bus 2, are coupled to a commercially available Motorola 6809 microprocessor 20. Under control of the microprocessor 20, the microSystem 6/10 system (not shown) communicates to the terminal, of which the invention is a portion, via the address and data busses 1, 2. Two commercially available 6116 RAMs 7 and 8 respectively are coupled to the 8-bit data bus 2 via commercially available 74LS245 transceivers 9 and 10. The transceivers 9 and 10 can transmit data in either direction from the bus to the RAM or from the RAM to the bus. The data is placed into the RAM 7 or 8 at addresses controlled by the microprocessor 20 via address bus 1. Selection of the RAM 7 or 8 in which data or attributes is to be stored is done via the low order bit of address bus 1 through logic not shown. Accordingly, when a message is to be written on the CRT screen (not shown), data (i.e. the message) is written into the RAM 7 via transceiver 9 at addresses provided by the microprocessor 20. In a similar manner, attributes (i.e. underlining, blinking, etc.) are written via data transceiver 10 into RAM 8. In order to write on the CRT screen (not shown), it must be done piecemeal for each character as each scan line progresses across the screen (not shown), as previously described supra. Subsequently, under control of the CRTC 3, each character of the message is addressed and read out into register 11. Similarly, each attribute corresponding to any given character is simultaneously read out into register 12. For any character of a message temporarily stored in register 11, a full address comprised of 8 high-order bits (which in reality represent the character code) and 4 low-order bits (which represent the scan lines, and which count 12 different scan lines 0–11) is presented to character generator 14. Character generator 14 is comprised of two commercially available 6116 RAMs which stores a set of character patterns of any distinctive type which can be addressed by the address formed by concatentating the character code with a scan line code as described above. As each separate scan line of a CRT screen (not shown) progresses through 80 character time-frames a portion of each character is written in each time-frame on each scan line as indicated at each time frame by the character temporarily stored in register 11 for that particular time-frame. The scan line address will cycle from 0 to 11, and when 12 complete scan lines have been made on the screen, then 80 characters would be completed on the screen as one row. The shift register 15 coupled to the character generator 14 and the load register 13 are the means for converting parallel data to serial data.

One feature of the invention is to have the attribute for a particular character arrive at the screen (not shown) at precisely the same time that the character arrives. This is accomplished by storing the character data in the screen data buffer and the attribute data in the screen attribute buffer. As each address is presented to the screen data buffer and the screen attribute buffer, the character being addressed is placed in register 11 and the attribute being addressed is placed in register 12. Thus the character code and the attribute code are available to the control logic to be written on the screen at the same time. Thus, since both the character information and attribute information is available at precisely the same time, it makes for very precise timing and a clear image on the screen.

It will now be shown that the invention provides a means of loading the character generator RAM 14 of FIG. 4 which requires the minimum of additional hardware over that required for the character generation function. The heart of the invention consists of adding the single register 13 of FIG. 4 to provide a path for the data to be written into the character generator 13, together with a Character-Generator-Load mode flip-flop 17 and associated control element 18 of FIG. 7. When this flip-flop is set to the Character-Generator-Load state, the Character Generator RAM is set to Write mode and the tristate output of register 13 described above is enabled so that the contents of the register 13 are written into RAM 14 on every character clock cycle so long as this mode remains in effect. Now, the address at which the data are written is the twelve-lead address consisting of the 4 scan line leads emanating from the CRTC 3 and the 8 leads emanating from the register 11 just as when the RAM 14 is used for its normal character generation function. Also note that register 11 is fed by the "data" half of the screen buffer RAM 7 while the register 13 which contains the data to be written is fed by the "attribute" half of the screen buffer RAM 8.

What remains then, is to show that there exists a combination of a "load" of the screen data/attribute RAMs and a programming or, as in actuality, a set of programmings of the CRTC 3 which in conjunction with the Load-Mode hardware described above will cause the desired table to be loaded into the character generator 14. The general strategy employed is to load the "attribute" side of the screen buffer with the screen patterns and to load the "data" side of the screen buffer with the internal code normally used to evoke the associated patterns. These patterns are 12 scan lines in height in the present instance, but, in order to simplify the addressing of the character generator RAM 14, the patterns are allocated to blocks of 16 sequential locations. This allows for an implementation where the address is simply the concatenation of the character code with scan line number. Since the screen buffer data and attribute RAMs contain 2048 (2K) locations, there is room for $2048/16=128$ patterns in one "load" of the data/attribute RAM. This is one half of the 256 patterns which are desired to be loaded into the character generator so that the procedure must be split into two phases. Typically, the split will be according to the internal code set with the first 128 codes being handled in the first phase and the remaining 128 codes being handled in the second phase. The remaining description will be directed to the operation of one of these phases, bearing in mind that the only distinction between the two phases is in the values of the data which are loaded into the data and attribute RAMs 7 and 8.

At the beginning of each phase, the screen attribute and data buffers are loaded with 128 patterns and the internal codes for same respectively, the codes being replicated 16 times over. The details of the ordering of these data within the screen buffer RAMs are governed by the operation of the CRTC 3 which we will now consider.

The CRTC 3 is capable of being loaded with certain parameters which will then control its operation. Among these parameters, the following are of interest to the present discussion.

Number of characters per row
Number of scan lines per character row
Number of character rows
Screen buffer starting address.

One purpose of the CRTC is to generate the proper sequence of addresses to the screen buffer to allow for the display of the patterns associated with the codes therein while also generating scan line numbers to serve as part of the character generator address as explained earlier. Another purpose of the CRTC is to afford ease of scrolling by allowing the beginning of screen to correspond to an arbitrary location in the screen buffer, hence the Starting Address parameter.

The operation of the CRTC consists of emitting a sequence of screen buffer addresses and scan line numbers (as well as synchronizing pulses not covered here). In particular, the sequence emitted consists of a linear sequence of screen buffer addresses commencing with the screen buffer Starting Address, the length of the sequence being equal to the Number of Characters per Row parameter, while holding the emitted scan line number at ZERO. After a suitable synchronization interval, this identical sequence of screen buffer addresses is repeated while holding the emitted scan line number at a value of ONE. This process is repeated for the number of times specified by the Number of Scan Lines per Character Row parameter. Following this, the entire process is then repeated with the next sequential set of screen buffer addresses, this level of iteration being repeated until the number of repetitions is equal to the Number of Character Rows parameter.

Thus, for a display of 80 characters per row with 12 scan lines per character row and 25 character rows, the sequence would consist of the first 80 addresses (commencing with the Screen Buffer Starting Address) with the scan line number held equal to ZERO followed by these same first 80 addresses with the scan line number held equal to ONE, etc. until the scan line number equals 11. Following this, the second 80 addresses are generated 12 times over, etc., until lastly the 25th set of 80 addresses are generated twelve times over (with the scan line number ranging from 0–11 with each repetition of the same set of addresses). With this knowledge of the inherent capability of the CRTC in mind, we choose to program the CRTC in the following "artificial" configuration for the purpose of loading the character generator.

Number of characters per row=128
Number of character rows=1
Number of scan lines per character row=variable
Screen Buffer Starting Address=variable.

FIG. 8 shows the organization of data in the Screen Buffer RAMs 7 and 8. The left half of each column represents the contents of the "data" buffer 7, while the right half represents the contents of the "attribute" buffer 8. The numbers across the top are the decimal address of the first 128 locations (those in the first row) while the numbers along the left side show the range of addresses encompassed in each of the rows. The case shown in FIG. 8 is for the first phase; i.e., for character codes 0–127 and as can be seen, the contents of the "data" buffer (the left half of each column) is simply this range of numbers in sequence and replicated 16 times over. The notation "Pa.b" (where "a" and "b" are numbers) shown for the contents of the right half columns refers to the numeric value for scan line "b" of the pattern for the character whose code is "a". To clarify this, let us use the example of FIG. 3. If the character code for "A" is 65 (which it is in ASCII), then we see that P65.0=0, P65.1=16 (00010000 Binary), P65.2=40 (00101000 Binary), etc.

The appropriate pattern, organized as above, is loaded into the screen buffer by a suitable program residing in the 6809 μP 20 at the start of each phase.

We will now describe the operation of the loading algorithm. Due to constraints imposed by the noraml functioning of the CRTC, the process for one phase must be divided into 16 passes. For each pass, the CRTC is programmed as described below, then the character generator is placed in the Load Mode until the entire CRTC sequence has been emitted. (This is determined by monitoring by means not shown here of the Vertical Sync signal emitted by the CRTC at the end of each complete sequence that it generates.) For the sake of completeness, as well as for simplicity, we will describe the loading of patterns with the full range of 16 scan lines recognizing that improvement in loading time would be achieved by only loading those scan lines actually used for the display.

FIG. 9 shows the values used for the Starting Address and Number of Scan Line parameters for each of the sixteen passes. We see that on the first pass, the Starting Address is set to the address corresponding to the beginning of the last line of FIG. 8, this being the area where the 15 slices of scan lines of the character patterns are stored. The CRTC will sequence through this row of addresses sixteen times over while stepping the scan line number from 0 to 15. Now, since the "data" halves of each location simply contain the sequenc 0–127 and since this, together with the scan line number, forms the address to the Character Generator RAM 14, this means that the scan line 15 patterns (the right halves of the last row of FIG. 8) will be written sixteen times over into the Character Generator 14. The first fifteen of these iterations are not desired, but the sixteenth does load the scan line−15 pattern information into the proper locations. In the second pass, the Starting Address is set to 1792 (the next to last row of FIG. 8) but this time the number of scan lines is programmed for 15. This means that on this pass the scan line number output by the CRTC will only range from 0 to 14 so that the scan line−15 pattern information which was loaded in the first pass will remain intact. Again, on this pass, only the last of the iterations (fifteen this time) through the 128 specified addresses in the screen buffer is fruitful. And so the process proceeds, moving up one row of FIG. 8 each time, while decreasing the Number of Scan Lines parameter by one until on the last (sixteenth) pass we are at last down to a case which is 100% efficient; namely scanning once through the first 128 locations. At this point, the half of the character generator appropriate to the current phase is fully loaded.

Figure 5:
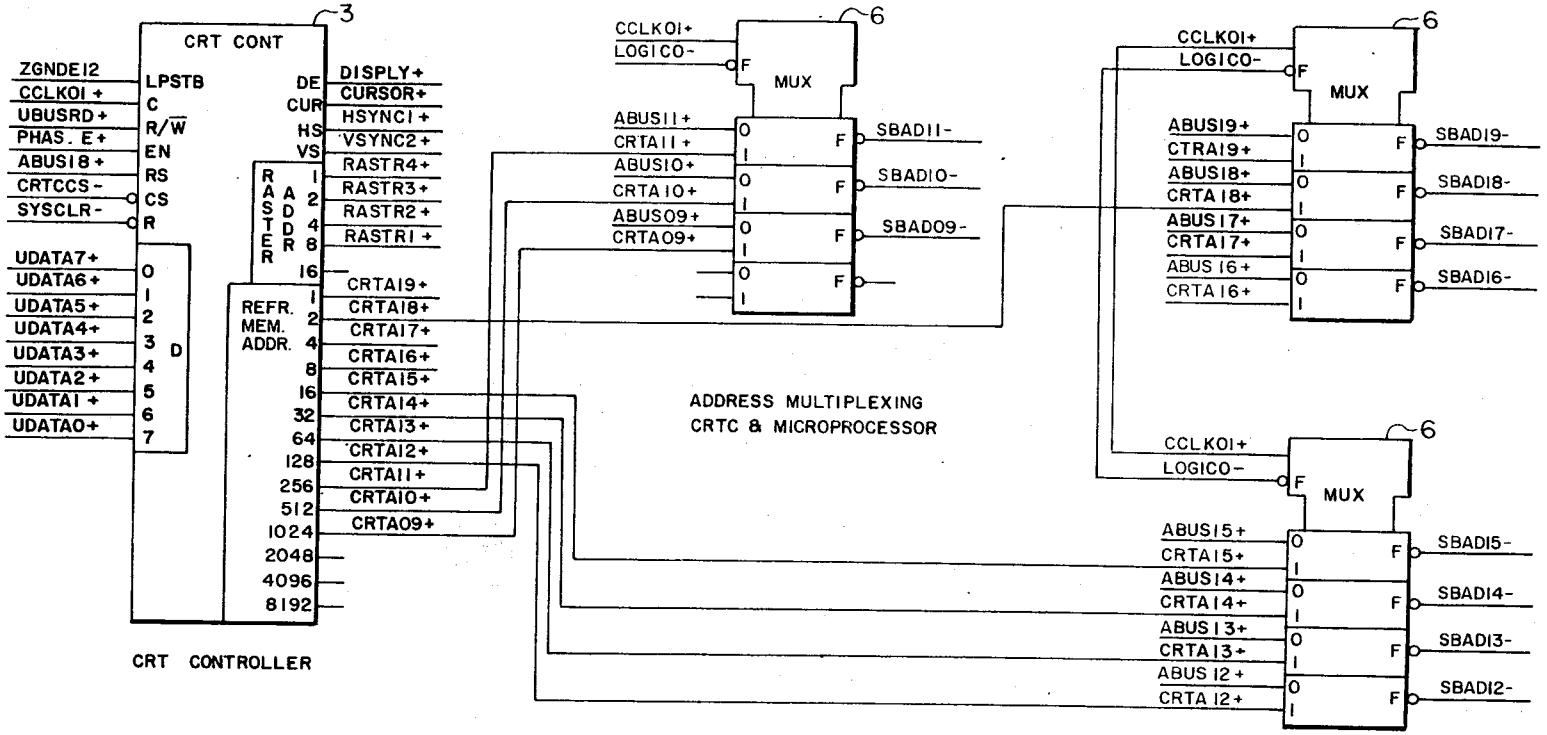
FIG. 5 is a detailed logic block diagram of the CRT controller and the MUXs of the invention.
Figure 6:
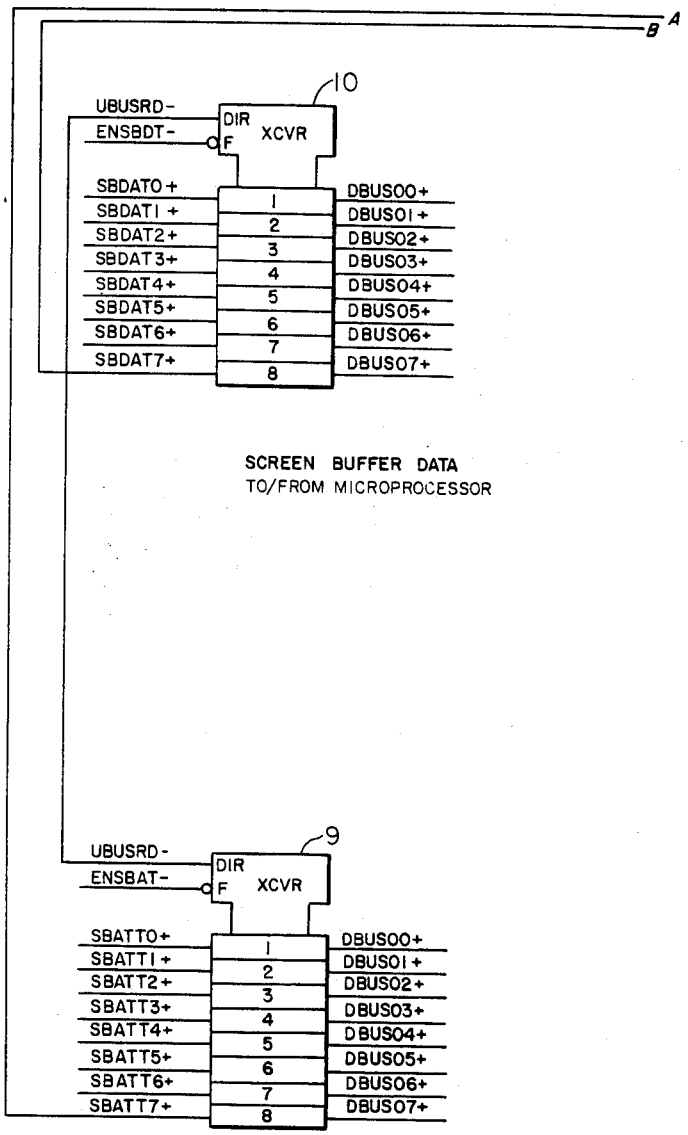
FIG. 6 is a detailed logic block diagram of the transceivers to/from the microprocessor, the screen attribute buffer and screen data buffer of the invention.
Figure 6:
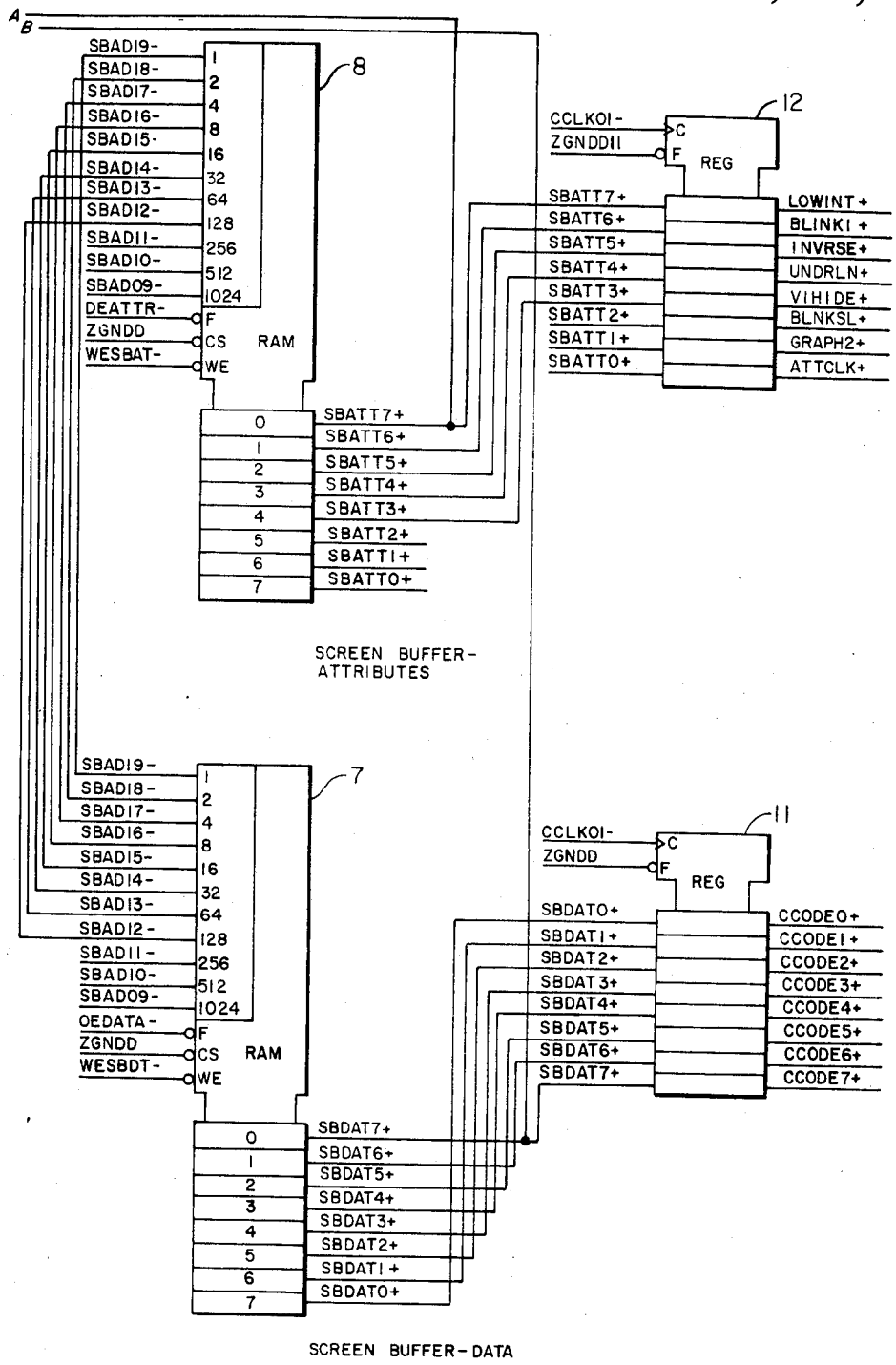
Figure 7:
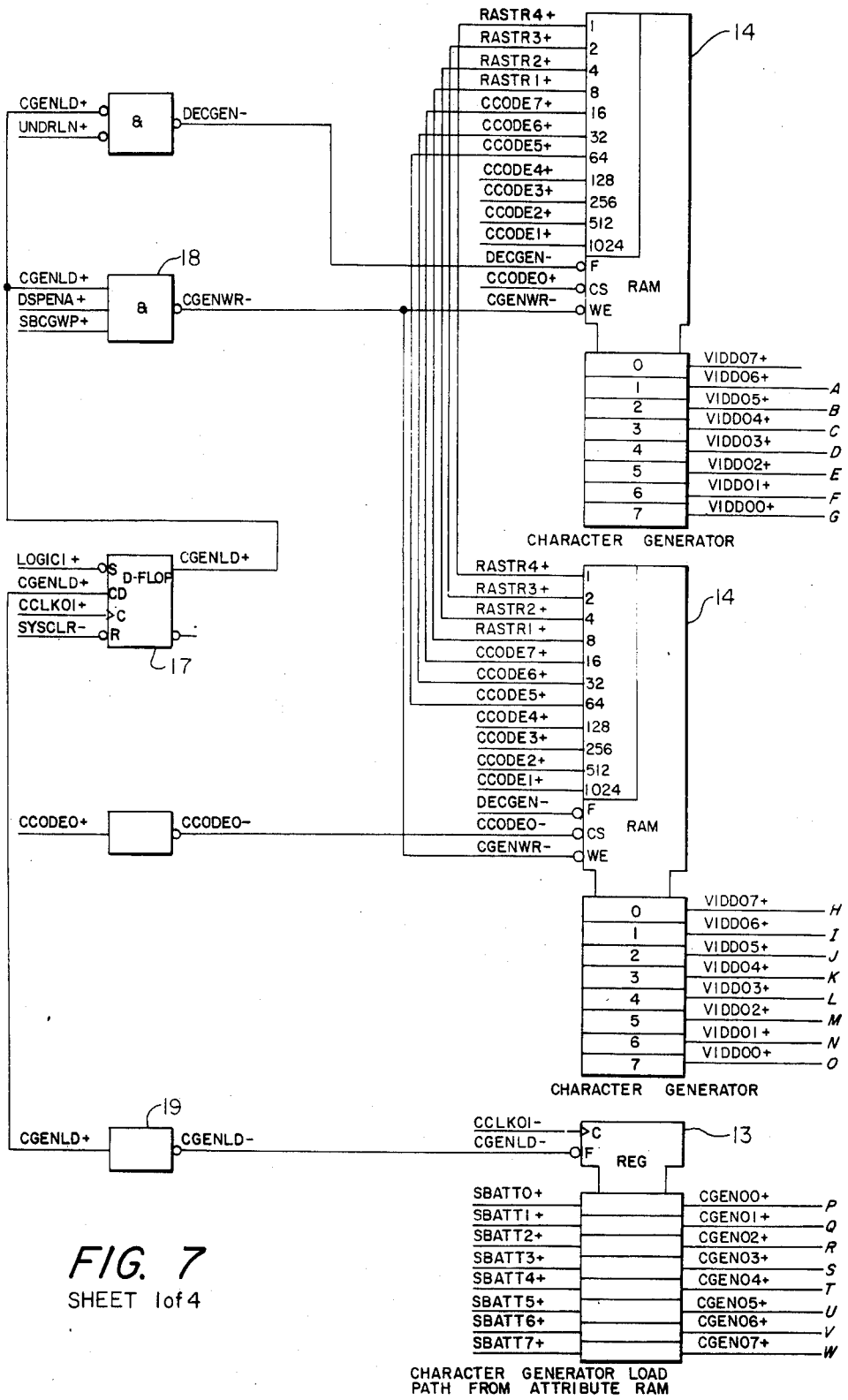
FIG. 7 is a detailed logic block diagram showing the character generator and various storage registers and shift registers.
Figure 7:
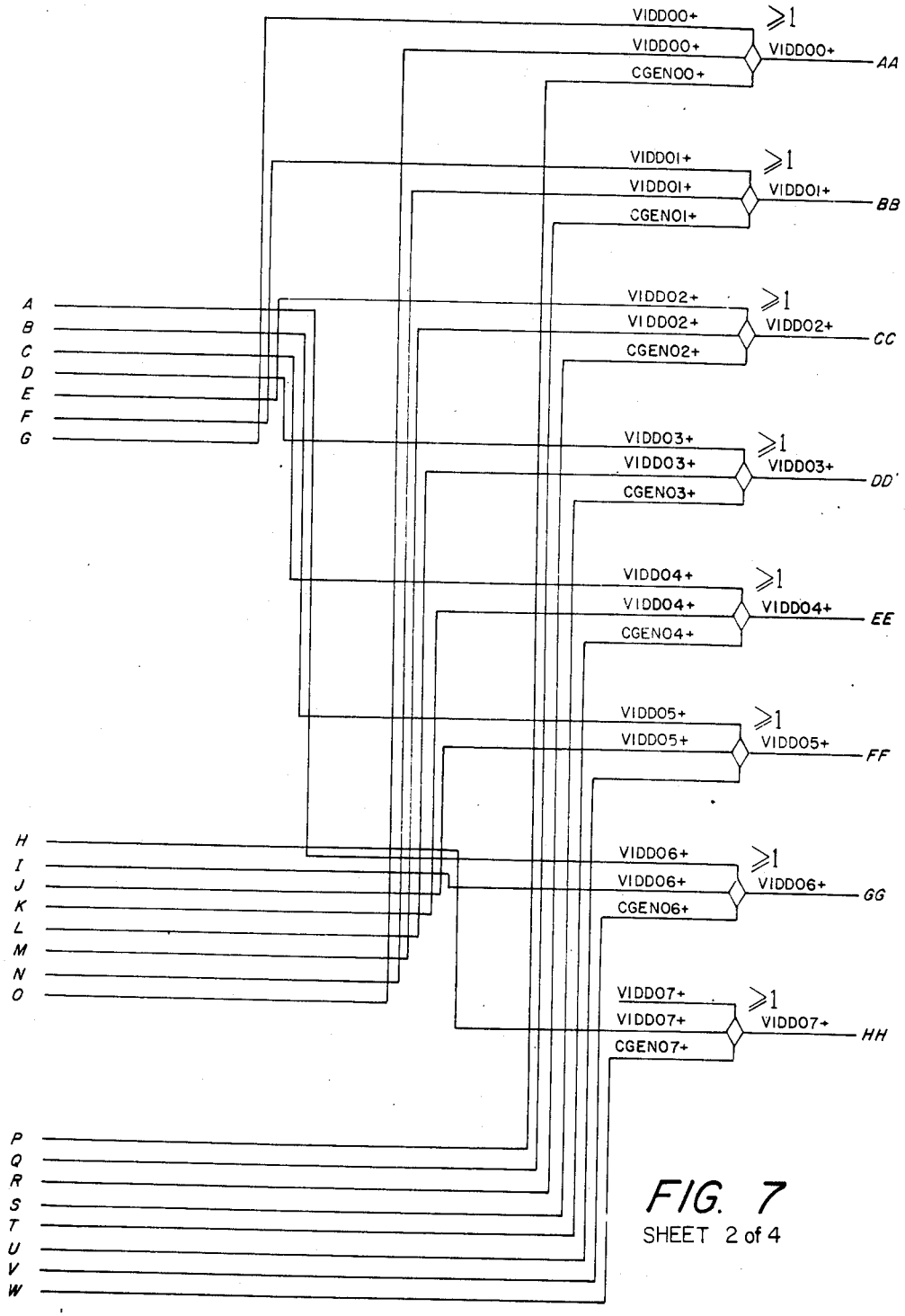
Figure 7:
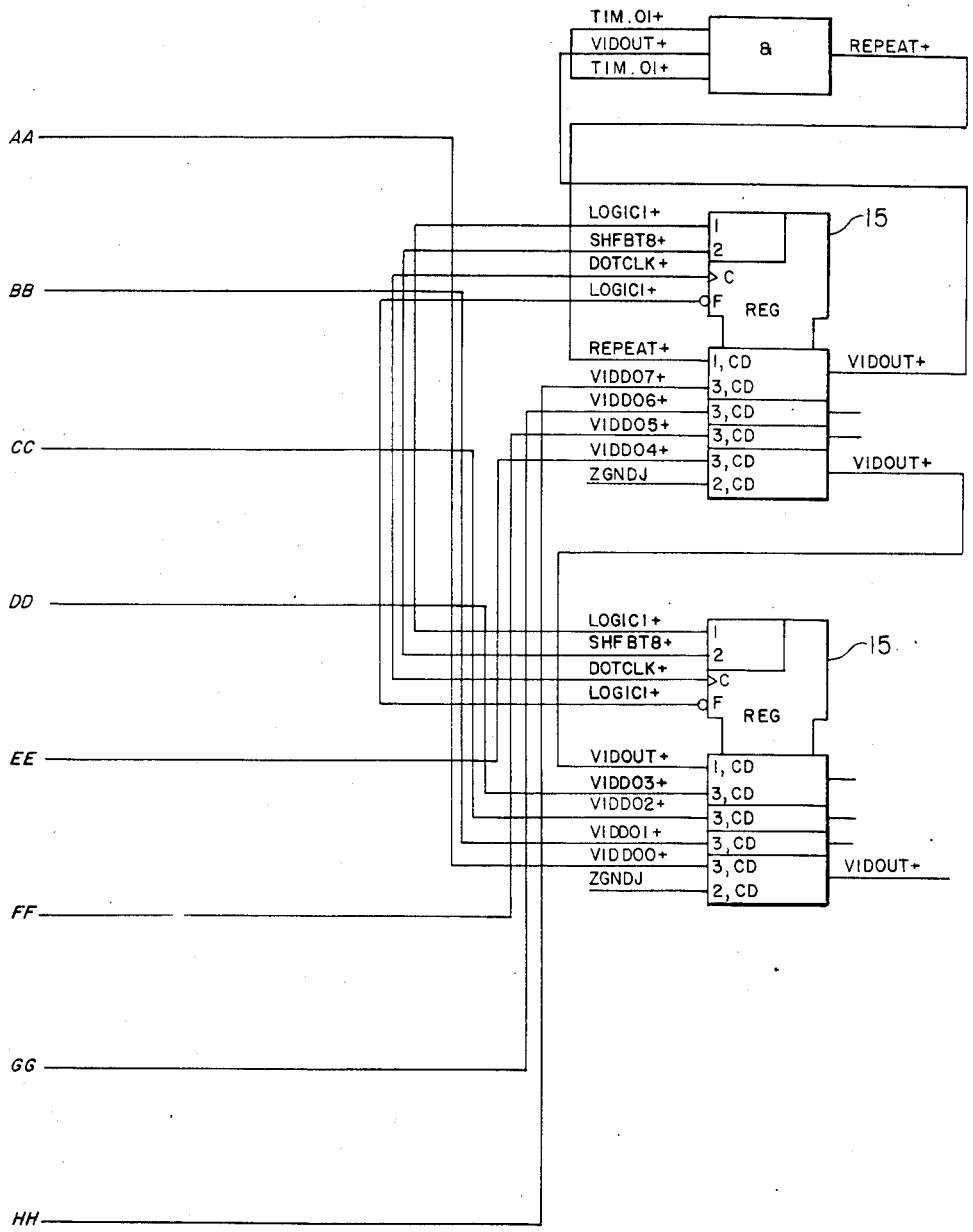
Figure 7:
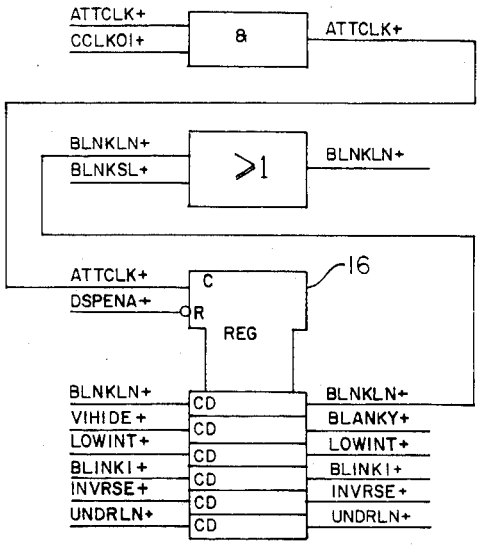

Referring to FIGS. 5, 6 and 7, there are shown detailed logic block diagrams of the invention of FIG. 4. It should be noted that elements on FIGS. 5, 6 or 7 that correspond to similar elements of FIG. 4 have been identified by the same reference numeral. Thus, the character generator of FIG. 4, having reference numeral 14, is also identified by reference numeral 14 on FIG. 7.

Referring now to FIG. 6, screen data buffer 7 and screen attribute buffer 8 coupled together comprise the 2K×16 screen buffer. Data from the 8-bit data bus 2, shown on FIG. 4, is applied to data bus leads DBUS00 through DBUS07 of both transceivers 9 and 10. Screen buffer data signals SBDAT0–SBDAT7 on transceiver 10 are applied to the SBDAT0–SBDAT7 terminals of screen data buffer 7 when data is being transmitted from the bus to be written into the screen data buffer 7. In a reverse manner, data from screen data buffer 7 can be read out onto bus 2 via transceiver 10. In a similar manner, data representing attributes can be written into or read out of the screen attribute buffer 8, and to or from the bus 2 via the data bus terminals DBUS00 through DBUS07 and screen buffer attribute terminals SBAT0 through SBAT7 of transceiver 9. In transferring information into or out of the screen buffer memories 7 and 8, it is transmitted to or from locations addressed by signals on terminals SBAD09 through SBAD19. Additionally the write enable signal WESBAT or WESBDT or screen buffer attribute 8 or screen data buffer 7 must be true. This technique of using unique write enable signals to select one or the other memory permits the screen data buffer to be stored in one memory bank; whereas the screen buffer attributes are stored in another memory bank.

When it is desired to generate a character, the information in screen data buffers 7 or 8 is read out into register 11 and 12 in synchronism with the scan line time intervals. It will be seen, therefore, that screen buffer data on terminals SBDAT0 through SBDAT7 will be applied to the SBDAT0–SBDAT7 terminals of register 11. In a similar manner, data from screen attribute buffer 8 is applied to register 12. The information in register 11, for example, is the character code required for that particular time interval. This character code is applied to the CCODE0 through CCODE7 terminals of the character generator 14. Additionally the raster scan line address signals on terminals RASTR1 through RASTR4 of CRT controller 3 are applied to the character generator 14 on raster scan address line terminals RASTR1 through RASTR4 of character generator 14. Accordingly as raster scan lines 0–11 are addressed, and as each character is presented to the character generator in synchronism with the scan line time intervals, the character generator 14 decodes a portion of the character and provides video output signals on terminals VIDD00 through VIDD07 of shift registers 15 on sheet 3 of FIG. 7 via lines VIDD-00–VIDD07 of sheet 2 of FIG. 7. These signals are input in parallel and are shifted out serially on terminal VIDOUT.

Referring now to FIG. 5, the CRT Controller (CRTC) 3 generates all of the timing for the display. This consists of the screen buffer address sequence emitted on terminals CRTA09–CRTA19, the raster scan line number sequence emitted on terminals RASTR1–RASTR4, as well as the horizontal and vertical synchronizing signals HSRNC1 and VSYNC2 and the display enable signal DISPLY. The CRTC 3 is capable of being "programmed" i.e., being loaded with control parameters by virtue of having the signals UDATA0–UDATA7 from data bus 2 applied to its data terminals and suitable control signals being applied, such as UBSRD PHAS.E, ABUS18 and CRTCCS. The multiplexors (MUX) 6 are for the purpose of selecting an address for the screen buffer RAMs, from either the CRTC 3 or from the address bus 1. The former case is selected during (a portion of) every display character time to allow for reading out of the coded display data and attributes; while the latter case is selected under control of the microprocessor 20 when it is caused to write into or read out from the screen buffer for the purpose of causing the information to be displayed to be properly stored in the screen buffer. (The specifications for the controllers, such as the CRT controller are to be found in the Motorola Semiconductor Catalog beginning at 4-457; while the specifications for other elements are to be found in the Texas Instrument TTL Data Book for Design Engineers, Second Edition.)

Having described the invention so that a person of ordinary skill in the art can make and use it without undue experimentation, those skilled in the art will realize that many variations and modifications can be made to produce the described invention and still be within the spirit and scope of the claimed invention. Thus, some of the hardware and/or steps may be altered or replaced by different hardware and/or steps which will provide the same result and fall within the spirit of the claimed invention. It is the intent, therefore, that the invention be limited only as indicated by the scope of all the claims.

We claim:

1. A programmable character generator arrangement used with raster scan display apparatus to display characters thereon, said character generator arrangement comprising:

a screen data buffer in which is normally stored character codes representing characters that are to be displayed on said display apparatus, the characters codes in said screen data buffer being read out serially in synchronization with the raster scan of said display apparatus;

a character generator in which is stored first display information and which is addressed using said character codes serially read out of said screen data buffer, said character generator generating a first display signal that when input to said display apparatus displays thereon the characters represented by said character codes;

a screen attribute buffer in which is normally stored attribute codes representing display modifications that are to be made to characters to be displayed on said display apparatus, said attribute codes being read out of said screen attribute buffer serially in synchronization with the raster scan of said display apparatus and being input thereto, said display apparatus responding to said attribute codes to modify the display of said characters;

multiplex means operable when it is desired to reprogram said character generator with second display information that will cause different characters to be displayed when addressed using said character codes, for loading addresses for said character generator into said screen data buffer rather than character codes, and said second display information into said screen attribute buffer rather than attribute codes; and means for transferring said second display information stored in said screen attribute buffer into said character generator at addresses stored in said screen data buffer, and thereafter character codes stored in said screen data buffer are again serially read out therefrom and used to address said character generator to read out said second display information that when input to said display apparatus causes the display of said different characters.

2. The programmable character generator arrangement in accordance with claim 1 further comprising:

a first register used to store said character codes serially read out of said screen data buffer, and character codes stored in said first register are used to address said character generator; and a second register used to store said attribute codes serially read out of said screen attribute buffer, and attribute codes stored in said second register are input to said display apparatus to modify the display of characters displayed thereon.

* * * * *